US006164046A

United States Patent [19]

Werner et al.

[11] Patent Number: 6,164,046

[45] Date of Patent: Dec. 26, 2000

[54] HIGH SPEED MACHINE FOR INSERTING SHEETS INTO ENVELOPES

[75] Inventors: Todd C. Werner, 1400 49th Ave. NE., St. Petersburg, Fla. 33703; Alfred Milo, St. Petersburg, Fla.

[73] Assignee: Todd C. Werner, St. Petersburg, Fla.

[21] Appl. No.: 09/250,459

[22] Filed: Feb. 16, 1999

[51] Int. Cl.[7] ..... B65B 25/14

[52] U.S. Cl. ..... 53/569; 53/284.3; 53/381.7; 53/389.1

[58] Field of Search ..... 53/569, 252, 284.3, 53/381.7, 389.1, 206, 460

[56] References Cited

U.S. PATENT DOCUMENTS

| | | | |
|---|---|---|---|
| 1,960,959 | 5/1934 | Sague | 53/284.3 |
| 3,423,900 | 1/1969 | Orsinger | 53/284.3 |
| 4,525,986 | 7/1985 | Noll | 53/252 |
| 4,649,691 | 3/1987 | Buckholz | 53/284.3 |
| 4,817,368 | 4/1989 | DePasquale | 53/284.3 |
| 5,284,004 | 2/1994 | Metzler | 53/252 |
| 5,408,811 | 4/1995 | Satake | 53/569 |
| 5,626,001 | 5/1997 | Belec | 53/569 |

*Primary Examiner*—John Sipos
*Attorney, Agent, or Firm*—Ronald E. Smith; Smith & Hopen, P.A.

[57] ABSTRACT

A high speed machine that inserts about twelve thousand sheets or stacks of sheets of paper per hour into the same number of envelopes. A first table delivers an elongate horizontal queue of thousands of envelopes to an envelope hopper. A second table, parallel to the first table, includes a plurality of independently-controllable sheet feeders and delivers individual groups of stacked sheets to an envelope insertion station that is transversely spaced apart from the envelope hopper. A third table is disposed transversely to the first two tables and includes the envelope insertion station. Clamps carried by an elongate sprocket chain mounted in the third table sequentially remove envelopes from the bottom of the envelope hopper and pull them past an envelope flap-opening structure to the envelope insertion station where the envelopes are opened by a puff of air. The envelopes are then pulled past a moistening device, an envelope flap-closing device, and a roller that seals the envelopes and ejects them from the third table to a collection station. Pusher members that push the sheets into the envelopes at the envelope insertion station are mounted on a high speed rotary assembly that eliminates the back-and-forth motion of earlier pusher members.

19 Claims, 9 Drawing Sheets

HIGH SPEED MACHINE FOR INSERTING SHEETS INTO ENVELOPES

BACKGROUND OF THE INVENTION

1. Field of the Invention

This invention relates, generally, to machines that insert sheets of paper or other items into envelopes. More particularly, it relates to a feeder machine that operates at a very high speed.

2. Description of the Prior Art

Machines for inserting items such as sheets of paper into envelopes at a relatively high rate of speed have been known since the 1930s. They can perform about 8000 insertions per hour when properly maintained and adjusted. At least thirty six patents cover the original machine and various improvements thereto.

The known machine is mechanically complex. For example, it employs a total of nine cams for performing various functions such as opening and closing mechanical clamping devices, raising and lowering suction cups used for opening envelopes, and so on. It includes a large number of gears, belts, drive shafts and the like. There are so many mechanical complexities that the device even includes a unique device for taking looseness or play out of the mechanism. The mechanical complexity relies upon human oversight for frequent adjustment purposes but even a well-adjusted machine is subject to frequent paper jams and the downtimes associated therewith.

Moreover, the envelope feeder of the known machine holds only a short stack of envelopes. As a result, the machine operator must frequently replenish the stack. A taller stack is contraindicated because the mechanism must remove envelopes sequentially from the bottom of the stack. The mechanism cannot cope with the extra weight of a tall stack, or the changing weight of a stack that steadily decreases in height as the machine operates.

The earlier machine also includes a reciprocating, pivotally-mounted, pendulum-like arm that feeds each sheet of paper or small stack of sheets into each envelope. It swings forwardly to perform one insertion and then swings back to prepare for the next insertion. This back-and-forth cycle takes place eight thousand times an hour when the machine is operating smoothly. Since the arm has non-negligible mass, the need to change direction sixteen thousand times per hour places a strain on the machine and prevents faster operation.

Another limitation of the known machine that restricts it to 8000 insertions per hour is conveyor speed. If the conveyor that delivers the sheets to the envelopes is run any faster than its 8000 insertions per hour speed, the envelopes into which the sheets are to be inserted cannot be delivered to the insertion station quickly enough. Moreover, the increase in speed of the conveyor belt causes the sheets to fly from it.

Another source of the known machine's relatively slow speed of operation is the use of suction cups to open envelopes at the sheet insertion station. Since suction cups cannot grasp a moving envelope, each envelope must come to a full stop before the suction cups can be lowered into engaging relation thereto. After the sheets have been inserted, the suction cups must be released and moved upwardly again so that the cycle can be repeated for the next envelope.

The known machines are further limited because the envelopes and sheets to be inserted thereinto follow a parallel path of travel as they approach a sheet insertion station. This requires that rectangular sheets be inserted in a "narrow edge leading" position, i.e., the sheets are pushed into the envelope in their long dimension. This requires a time delay for indexing to occur and an acceleration of the paper thereafter to make up for the delay.

The known machines also incorporate flighted conveyor belts, in their collator section, where longitudinally spaced apart vertical walls divide the belt into bins of ten inches in length. If bins of different lengths are needed for a particular application, a different belt must be installed.

What is needed, then is a machine that can perform insertions at a rate of speed much faster than eight thousand insertions per hour.

There is a need as well for a machine with less mechanical complexity. A more elegantly-designed machine could operate at higher speeds with increased reliability and less downtime, and would require less operator attention.

A need also exists for an envelope feeder that does not require frequent replenishment.

Another need exists for a machine that does not rely upon a pivotally-mounted, reciprocating arm to push paper sheets into envelopes.

Moreover, there is a need for a machine that can deliver more sheets per hour without increasing the speed of the conveyor belt that delivers the sheets to an envelope insertion station.

There is a need as well for an improved means for opening envelopes prior to sheet insertion. The improved means should not require the envelope to reach a full stop before the insertion procedure begins and the improved means should not rely upon suction cups.

A need exists as well for a machine that can feed sheets of rectangular paper in a "wide edge leading" format so that the short side of a rectangular sheet is pushed into its envelope, thereby reducing the length of each pusher stroke and eliminating a need to index, delay and accelerate the mechanisms involved in the sheet insertion process.

A need is extant, further, for a machine having a flighted conveyor belt in its collator section that is not limited to ten inch bins and which can be modified to have bins of differing length without requiring changing of the belt.

However, it was not obvious to those of ordinary skill in this art how the needed improvements could be provided, in view of the art considered as a whole at the time the present invention was made.

SUMMARY OF THE INVENTION

The long-standing but heretofore unfulfilled need for an innovation that overcomes the limitations of the prior art is now met by a new, useful, and nonobvious invention.

In a first embodiment, the novel machine for inserting sheets into envelopes includes a first table means including an elongate envelope feed conveyor means and a second table means disposed in substantially parallel relation to the first table means. The second table means includes an elongate sheet feed conveyor means, at least one sheet feeder means and at least one sheet pusher means.

The novel machine further includes a third table means or envelope loading station disposed substantially transversely to the first table means and the second table means. The envelope loading station includes an envelope hopper. An elongate queue of envelopes is formed on the elongate envelope feed conveyor means of the first table so that keeping the envelope hopper full of envelopes requires infrequent additions of envelopes to the queue. The envelope hopper has a predetermined elevation less than a predetermined elevation of the elongate envelope feed conveyor means so that an envelope reaching the envelope hopper follows a downward path of travel as it exits the elongate envelope feed conveyor means and enters into the envelope hopper.

The envelope loading station includes a sheet insertion station that is transversely spaced apart from the envelope hopper.

An envelope displacement means is provided for displacing an envelope from the envelope hopper to the sheet insertion station. The envelope displacement means includes a clamp adapted to selectively engage and release an envelope. The clamp is mounted on a rotating chain means or belt means that follows a predetermined path of travel in a substantially vertical plane. The clamp is adapted to engage an envelope in the envelope hopper, to displace the envelope to the sheet insertion station, and to release the envelope at a predetermined location after displacing it away from the sheet insertion station.

A first cam means forms a part of a mechanism for removing an envelope from the envelope hopper. A second cam means opens and closes the clamp when the clamp is positioned in predetermined juxtaposition to the envelope hopper. The second cam means opens the clamp to enable it to receive an envelope at the envelope hopper and said second cam means then closes the clamp to enable it to engage the envelope and displace it to the sheet insertion station.

A third cam means at the sheet insertion station opens the clamp to allow sheet insertion and then closes the clamp again. A fourth cam operates an insert entering finger assembly. All four cams are mounted on a common, transversely disposed, motor-rotated shaft and are transversely spaced apart from one another.

The at least one sheet pusher member is mounted on a predetermined structure including a rotating chain means or belt means that forms an endless loop so that the at least one sheet pusher member follows a predetermined path of travel that alternately carries it towards the sheet insertion station and away from the sheet insertion station in the absence of an abrupt change of direction. The rotating chain or belt means includes a pair of parallel, transversely spaced apart chain or belt means and the at least one sheet pusher member is disposed therebetween.

The at least one sheet pusher member includes at least one set of sheet pusher members, and the at least one set includes a plurality of sheet pusher members disposed in transversely spaced apart relation to one another.

The at least one set of sheet pusher members may include a plurality of sets of sheet pusher members that are longitudinally spaced apart from one another at equidistantly spaced intervals.

Significantly, only two sets of sheet pusher members are employed for sheets having a length greater than six inches, such as 9×12 envelopes, for example. Where the chain means that carries the pusher members is forty inches in length, the two sets of pusher members are spaced twenty inches from one another. Moreover, the flighted conveyor that carries the sheets to the sheet insertion station is divided by vertical walls that are spaced 14¼ inches from one another.

For sheets having a length greater than four inches but less than six inches, the machine is reconfigured so that three sets of pusher members are installed on the chain means. Since the sets are equidistantly spaced apart from one another, on a forty inch chain means the spacing between three sets of pusher members is 13.33 inches. Moreover, the walls that divide the flighted conveyor into sheet-receiving bins are spaced 7⅛ inches apart.

Where the sheet length is less than four inches, four sets of pusher members are carried by the chain means, spaced ten inches from one another. The walls are spaced 7⅛ inches apart as in the three pusher embodiment.

Thus, the flighted conveyor of the inventive machine may be divided into bins of differing lengths, thereby eliminating the need to change conveyor belts when a different bin size is needed.

There are no gear ratio changes when the machine is reconfigured from a four pusher member configuration to a two pusher member configuration i.e., the only gear ratio change is made when three pusher members are used. This allows the feed conveyor to operate at the same speed for all pusher member configurations.

A plurality of transversely spaced apart air jets are formed in an insert plate that lies flush with the surface of the second table means in juxtaposition with the envelope insertion station. A sensor means detects the presence of an envelope in the envelope insertion station and activates a pneumatic means for causing a puff of air to flow from the air jets to open an envelope positioned in the envelope insertion station. The puff of air may be initiated before the envelope comes to a complete stop. Moreover, the use of air to open the envelopes eliminates the suction cups heretofore used and the mechanical complexities associated therewith. An insert entering finger or guide that is used in prior art machines to hold the envelope open during sheet insertion may also be used in conjunction with the novel air jets. This invention improves the known entering finger by equipping it with air jets as well to enhance its effectiveness.

In an alternative embodiment of the novel machine, the first table means is eliminated. Instead of an elongate envelope queue in a horizontal plane, a high capacity, generally vertical demand envelope feeder is used. Such envelope feeders are known and can be used as a substitute structure for the elongate first table means.

It is a primary object of this invention to provide a machine that inserts sheets of paper into envelopes at a speed of about twelve thousand insertions per hour.

A closely related object is to provide a machine having reduced mechanical complexity vis a vis the machines of the prior art.

Another object is to provide an envelope feeder with a substantially larger capacity than the envelope feeders heretofore known.

Still another object is to provide a machine that can be easily reconfigured to handle sheets that are less than four inches in length, between four and six inches, and in excess of six inches, all at a common conveyor speed.

Yet another object is to provide an improved means for opening envelopes at a sheet insertion station.

Another important object is to provide a "wide edge leading" insertion for rectangular sheets to reduce the length of the pusher stroke and to eliminate the delay and acceleration required of prior art machines during sheet insertion.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
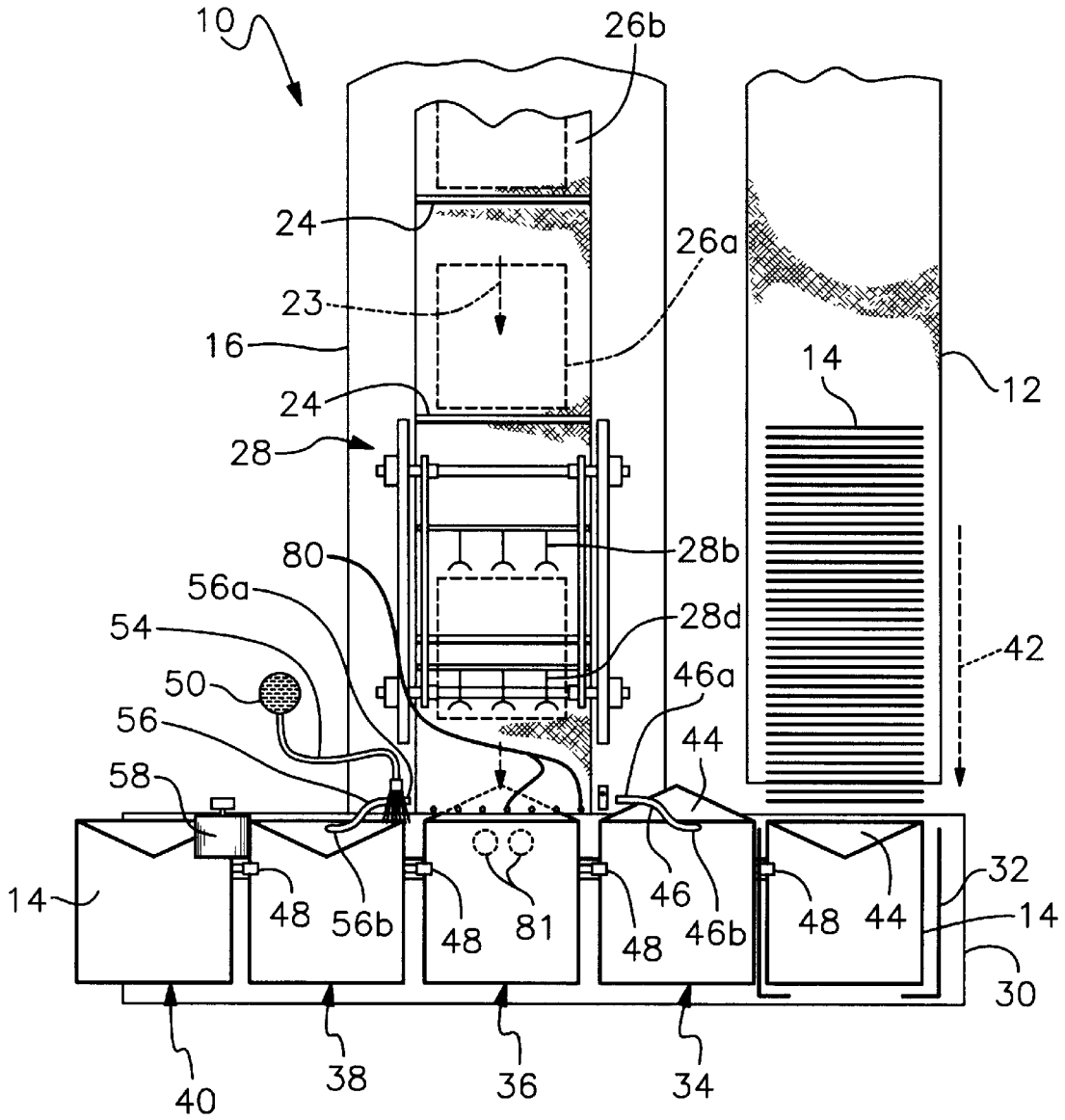
FIG. 1 is a top plan view of a first embodiment of the machine where two sets of pusher members are employed.

Referring now to FIG. 1, it will there be seen that an exemplary embodiment of the invention is denoted as a whole by the reference numeral 10.

In a first embodiment, machine 10 includes a first elongate table means or envelope feed conveyor means 12 having a very large plurality of envelopes 14 disposed thereatop.

A second elongate table means, denoted 16 as a whole, is disposed in parallel relation to first elongate table means 12, in transversely spaced apart relation to first elongate table means 12.

Figure 2A:
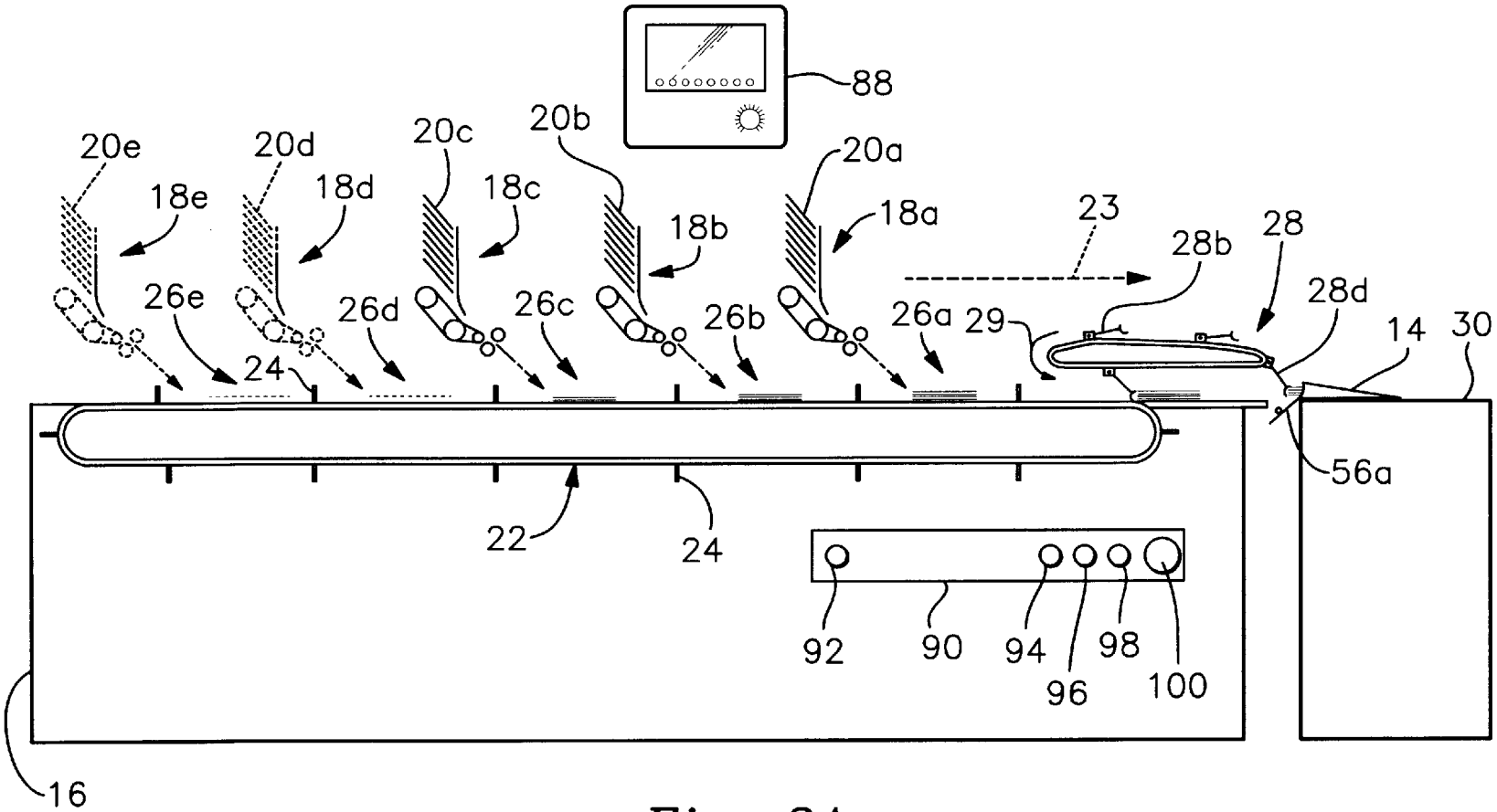
FIG. 2A is a side elevational view of said first embodiment.

As depicted in FIG. 2A, a plurality of sheet feeders are mounted in longitudinally spaced apart relation to one another. In this particular embodiment, there are five sheet feeders, denoted 18*a–e*, but a commercial embodiment of the invention includes six of such feeders (see FIG. 5). The number of sheet feeders is not critical to the operation of machine 10. As in prior art machines, each sheet feeder carries a replenishable stack of individual paper sheets 20*a–e* to be inserted into envelopes as a set.

A flighted conveyor belt 22 carries the paper sheets to the forward end of second table means 16, as indicated by arrow 23, where the individual stacks are sequentially inserted into envelopes 14. In FIG. 2A, belt 22 is divided into sections or bins by longitudinally-spaced apart vertical walls 24. This particular configuration is used for sheets having a longitudinal extent in excess of six inches; walls 24 are 14¼ inches apart. A sheet of paper that is to be positioned at the bottom of a stack is deposited into a bin at position 26*e* by a roller mechanism that is well-known. That sheet then advances to position 26*d* and the sheet that will be the second from the bottom in the stack is then deposited atop it and so on until the stack has been assembled for insertion into an envelope. In this example, the top sheet in the stack is deposited atop said stack at position 26*a* by sheet feeder 18*a*.

Note that only two sets of pusher members, denoted 28*b* and 28*d*, are used in this first embodiment. Where the pusher members are carried on an endless chain means or belt means 28 having a length of forty inches, the two sets of pusher members are spaced twenty inches from one another. Chain means 28 follows a generally elliptical path of travel so that the pusher members do not abruptly change direction as the chain means rotates in a vertical plane. It should be understood from FIG. 1 that chain means 28 includes two sets of parallel chain members disposed in transversely spaced apart relation to one another, and that the pusher members are disposed therebetween.

The configuration of FIG. 2A is employed when the sheets to be inserted are greater than six inches in length.

Figure 2B:
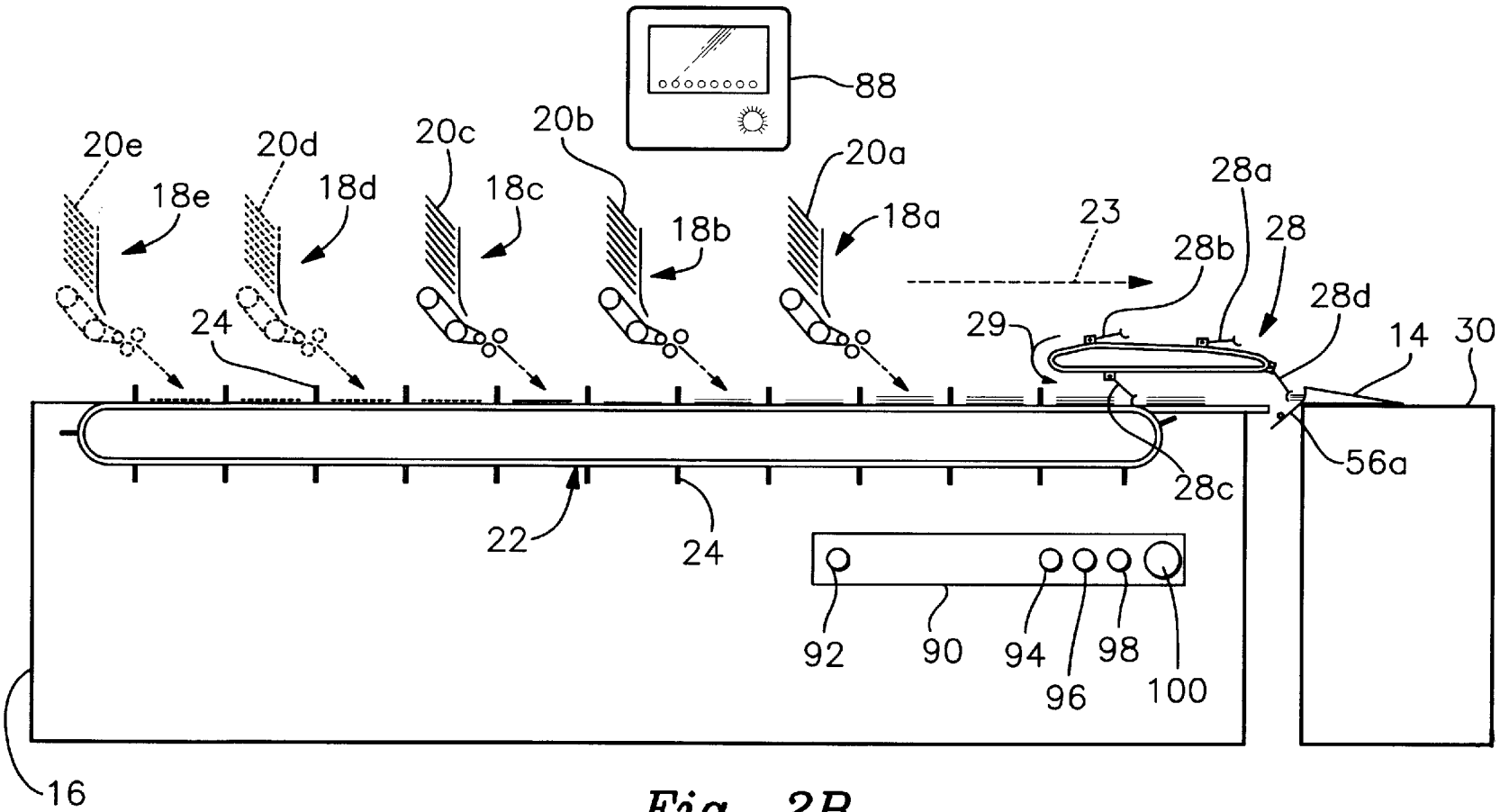
FIG. 2B is a side elevational view of a second embodiment where three sets of pusher members are employed.

In the configuration of FIG. 2B, walls 24 are spaced 7⅛ apart, and three pusher members, denoted 28*a*, 28*c* and 28*d* are employed. On a forty inch chain means, they are equidistantly spaced from one another at 13.33 inch intervals. This configuration is used when the sheets to be inserted are less than six inches in length but greater then four inches in length.

Figure 2C:
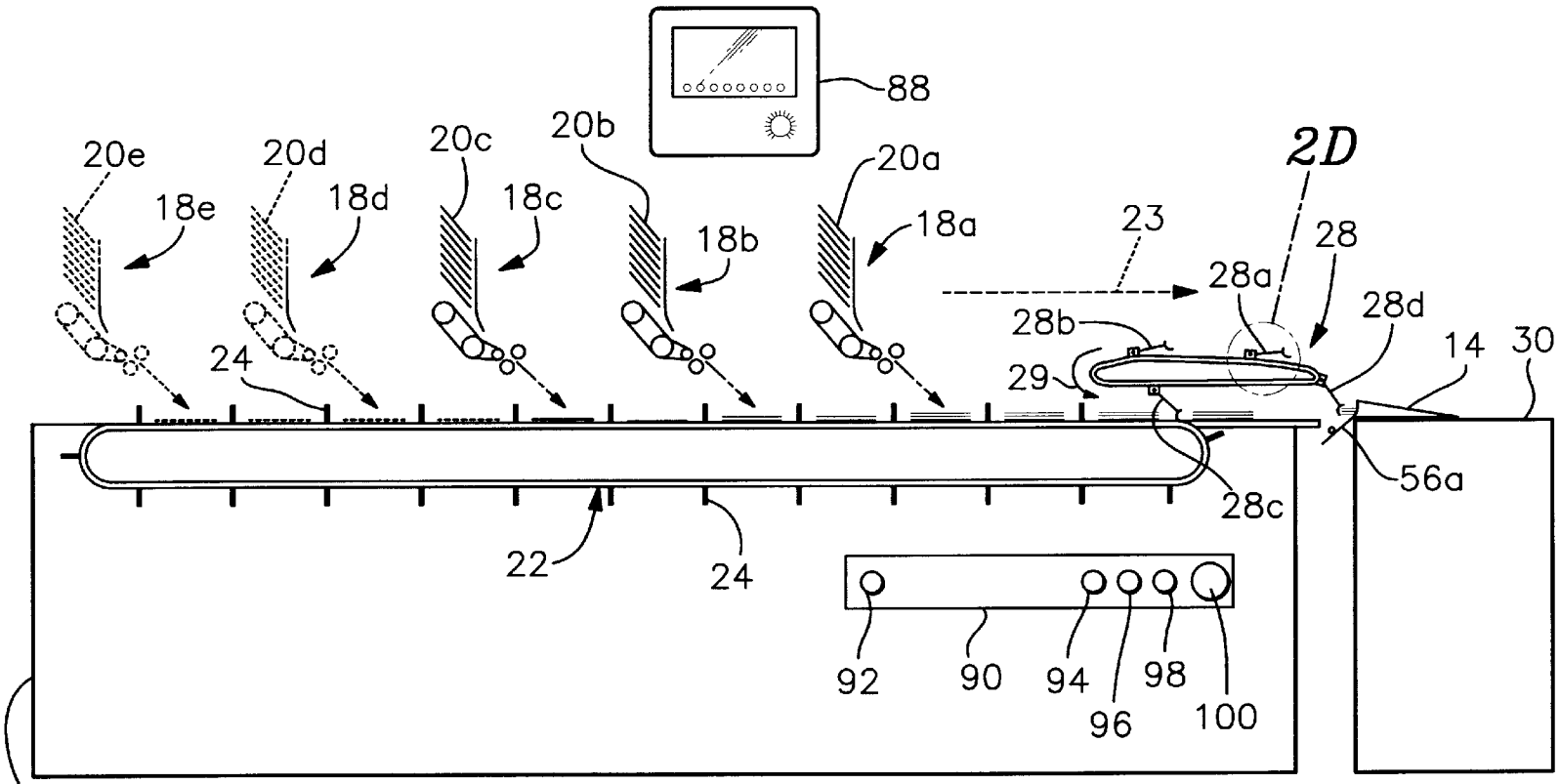
FIG. 2C is a side elevational view of a third embodiment where four sets of pusher members are employed.

In the configuration of FIG. 2C, walls 24 are spaced 7⅛ apart, and four pusher members, denoted 28*a*, 28*b*, 28*c* and 28*d* are employed. They are spaced ten inches from one another on a forty inch chain means. This configuration is used when the sheets are four inches or less in length.

Figure 2D:
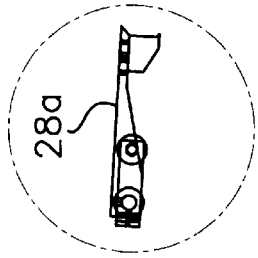
FIG. 2D is an enlarged view of the encircled area in FIG. 2C that is denoted 2D.

As indicated in FIG. 2D, each pusher member is pivotally mounted to chain means 28.

As indicated in FIG. 1, machine 10 further includes third elongate table means or envelope loading station 30 having a longitudinal axis disposed transversely to the longitudinal axis of first table means 12 and second table means 16. Third table means 30 includes an envelope hopper 32 at a first end thereof, said first end being in longitudinal alignment with first table means 12. Third table means 30 further includes an envelope flap-opening station 34, a sheet insertion station 36, an envelope closing station 38, and an envelope ejection station 40.

Sheet insertion station 36 is disposed in longitudinal alignment with second table means 16.

The operation of machine 10 will now be described.

A conveyor belt, not shown, is rotatably mounted in first table means 12 so that its forward-traveling section is substantially flush with the top surface of said table means 12. It carries a long queue of envelopes 14 in the direction indicated by single-headed directional arrow 42, said arrow indicating said direction of forward travel.

Figure 3:
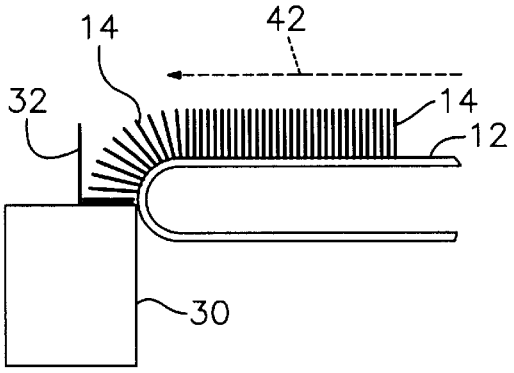
FIG. 3 is a side elevational, diagrammatic view of the novel envelope feed conveyor.

As best understood in connection with FIG. 3, when an individual envelope 14 reaches the end of table 12, it follows a downward path of travel having a rounded ninety degree bend. This path of travel places it in envelope hopper 32 which has substantially the same height or depth as an envelope hopper of the prior art. However, the horizontal queue of the envelopes atop the conveyor means of first table 12 enables a machine operator to place thousands of envelopes atop said conveyor means without adding to the pressure or weight bearing down on the lowermost envelope in hopper 32. Moreover, the pressure applied to the lowermost envelope does not change as the length of the queue of envelopes grows shorter or longer.

Returning now to FIG. 1, it should be noted that flap 44 of each envelope 14 is closed when it is in hopper 32. A stationary flap opener means 46 in the form of a curved rod has a proximal end 46*a* positioned below the plane of third table means 30 and a distal free end 46*b* disposed in the path of travel of each flap 44 as the envelopes are sequentially pulled from the bottom of hopper 32. Thus, rod 46 mechanically displaces each flap 44 into a fully open position; as indicated in FIG. 4, each flap 44 is rotated more than one hundred eighty degrees when it is fully open.

The lowermost envelope in hopper 32 is engaged at its inboard end by a clamp 48 (see FIGS. 1 and 4) having a pair of opposed jaws that open and shut. When open, clamp 48 receives or releases an inboard end of the lowermost envelope and when closed, said clamp engages said inboard envelope.

Figure 4A:
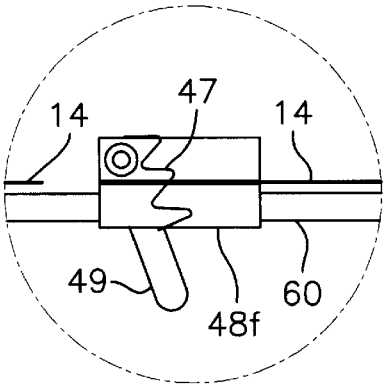
FIG. 4A is a detailed view of the encircled area denoted 4A in FIG. 4.
Figure 4B:
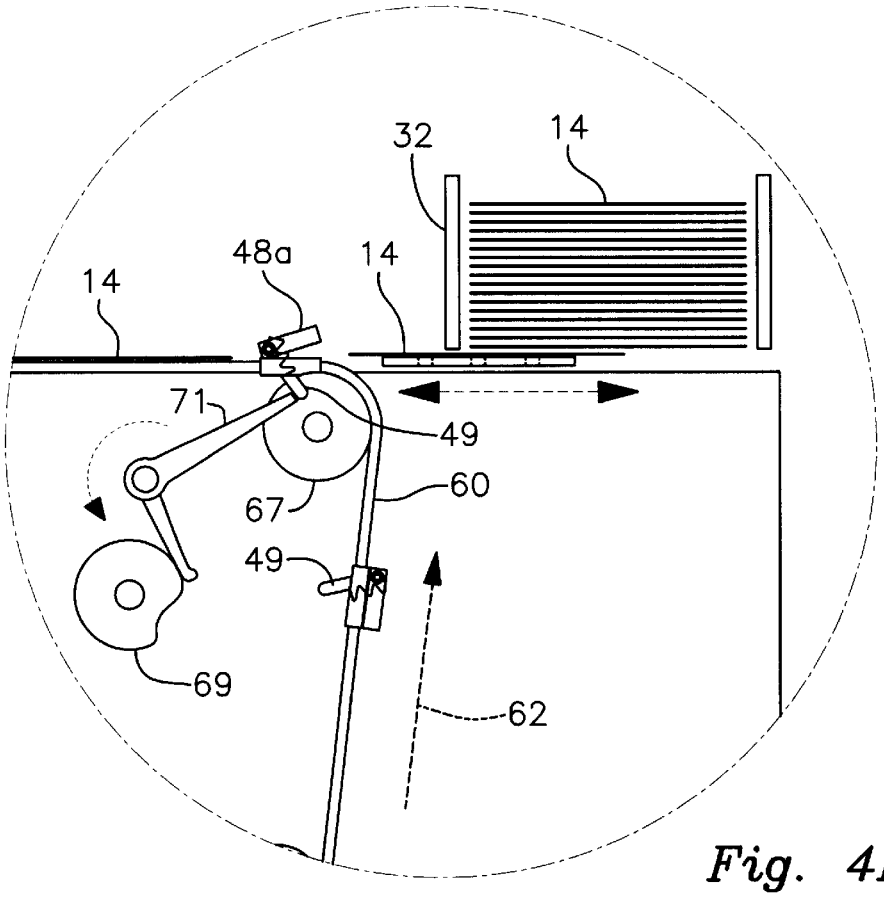
FIG. 4B is a detailed view of the encircled area denoted 4B in FIG. 4.
Figure 4:
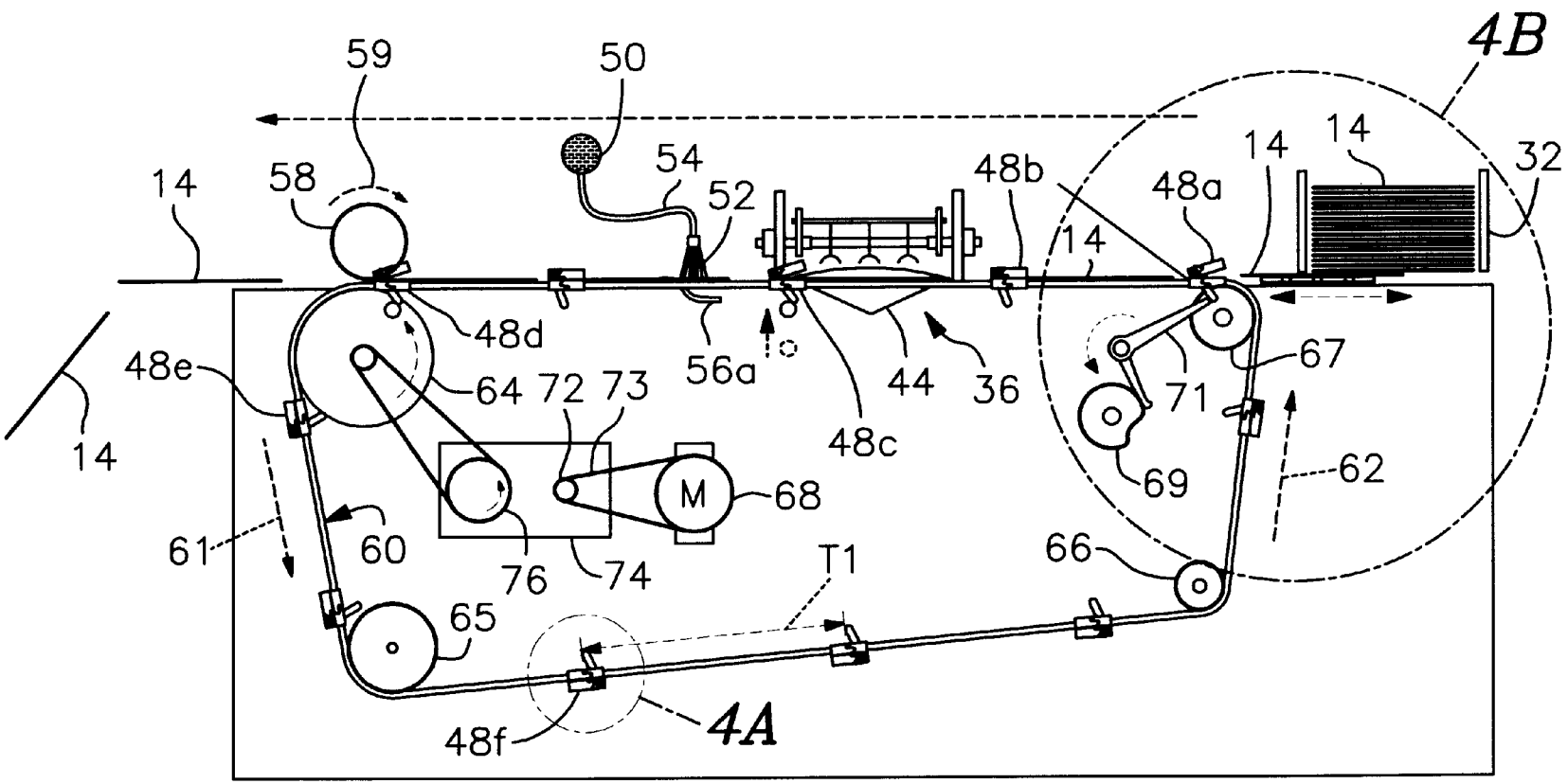
FIG. 4 is a front elevational view of the machine.

As perhaps best understood in connection with FIG. 4, the clamp at position 48*a* is open and ready to receive between its opposed jaws the inboard end of an envelope 14 that is being removed from envelope hopper 32.

The clamp at position 48*b* is closed and has pulled a lowermost envelope out of hopper 32 and past curved rod 46 and thus flap 44 has been fully opened so that it lies in a plane more than one hundred eighty degrees from its initial, closed position.

The clamp at position 48*c* has pulled an envelope to sheet insertion station 36 where at least one sheet of paper or similar item is inserted into an opened envelope.

Water in elevated reservoir 50 is conveyed under gravity feed to brush 52 by hose 54; the clamp in position 48*d* has pulled an envelope, with flap 44 still open, under said brush to moisten the adhesive on the inside of the flap. A second curved rod 56 has an inboard end 56*a* disposed below the plane of the envelopes on table 30 and an outboard end 56*b* (FIG. 1) disposed above said plane so that the flap is closed as soon as the moisture is applied. Roller 58 turns in the direction indicated by arcuate arrow 59 in FIG. 4 and presses on the closed flap to seal the envelope.

The clamp in position 48*d* opens to release the envelope when an actuator 49 that depends therefrom (see FIG. 4A) encounters roller 64 and the envelope is propelled to a collection table, not shown, that would be positioned at the left side of FIG. 4. The clamp at position 48*d* is approaching the position of the clamp at position 48*e* when the envelope is propelled to the collection table, because the clamps follow a path of travel defined by sprocket chain 60 (or other suitable belt means). The direction of travel of sprocket chain 60 is denoted by directional arrows 61 and 62. Gear 64 is a driving gear and gears 65, 66 and 67 are idler gears.

A first cam, not shown, forms a part of a well-known mechanism that takes envelopes out of envelope hopper 32. A second cam 69 selectively opens and closes the clamp at position 48*a* either directly or by means of bell crank 71 or other suitable linkage means as depicted in this particular embodiment. A third cam, not shown, selectively opens and closes the clamp at position 48*c* so that the envelope can be opened for the sheet insertion process and immediately closed thereafter. A fourth cam is also employed to operate the insert entering finger assembly, disclosed hereinafter. Thus, there are only four cams in the inventive machine, whereas the known machines have about twenty cams.

As indicated in the detailed drawings denoted FIGS. 4A and 4B, each clamp is maintained in a normally closed configuration by a bias means such as spring 47, and each clamp has an actuator 49 that opens the opposed jaws of the clamp when displaced.

Motor 68 drives belt 73 that in turn rotates shaft 72 of indexing box 74. The first one hundred eighty degree rotation of shaft 72 results in a one hundred twenty degree rotation of wheel 76. The second one hundred eighty degree rotation of shaft 72 results in no rotation of wheel 76, i.e., there is a dwell of wheel 76 during said rotation of shaft 72. The arrow denoted T1 in FIG. 4 indicates the linear travel of a clamp 48 for each rotation of wheel 76.

This rotate and dwell pattern is a three stop, three position output, i.e., for each 360 degrees of input there is 120 degrees of output; 180 degrees of the input is dwell.

Indexing box 74 eliminates any need for a stepper motor, i.e., the output shaft of motor 68 rotates continuously, in the absence of starting and stopping.

Figure 5:
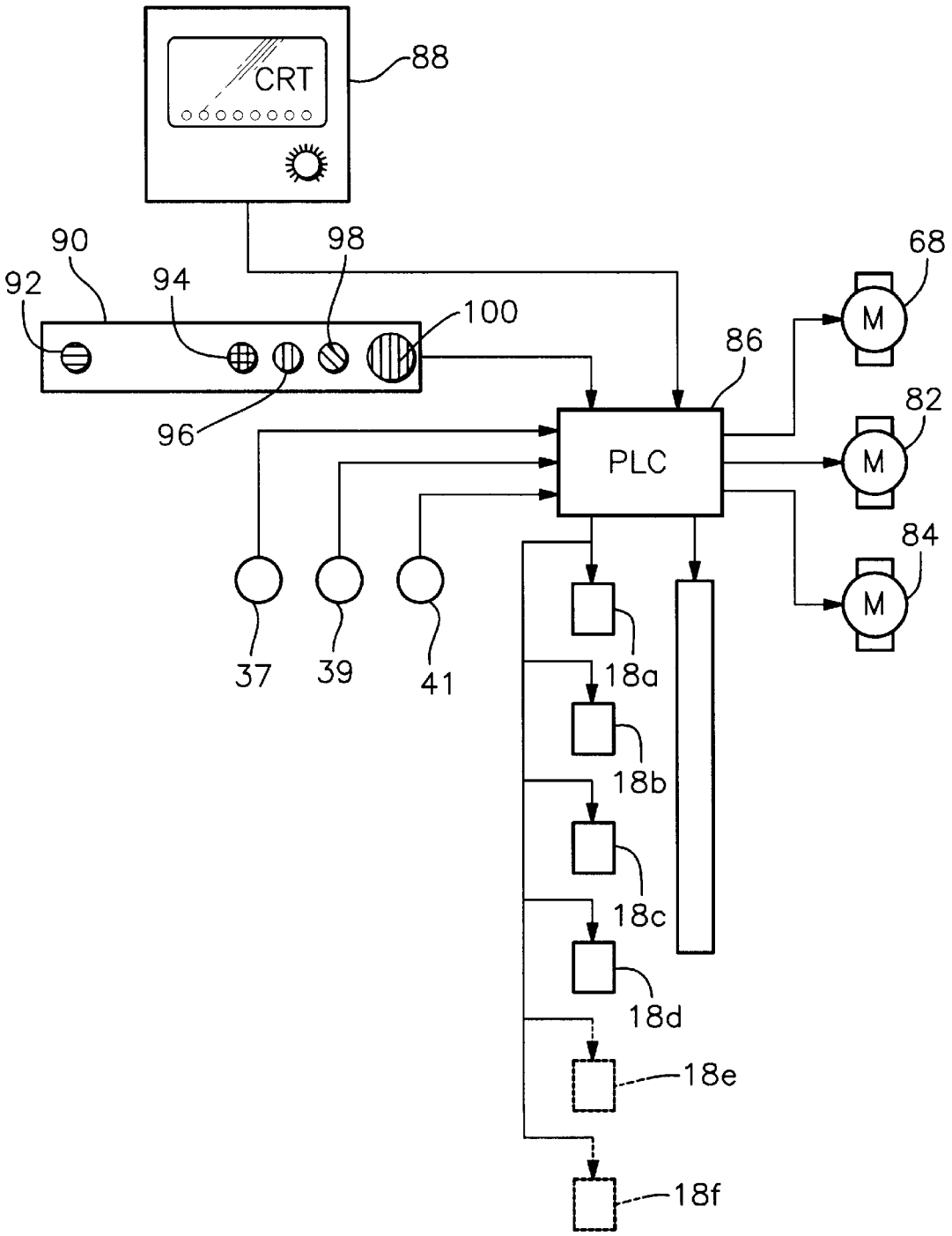
FIG. 5 is a diagrammatic representation of the control means for the novel machine.

FIG. 5 diagrammatically depicts the control means for novel machine 10. In this example, there are six sheet feeders 18*a*–f, as distinguished from the five sheet feeders depicted in FIG. 2.

Prior art sheet feeders, as mentioned earlier, are controlled as a group by a single motor means. Thus, each sheet feeder deposits one sheet on flighted conveyor 22 for each cycle of operation. However, if a customer wants sheet feeder 18*a* to deposit two sheets for every sheet deposited by sheet feeder 18*b*, the single motor assembly of the prior art cannot be used.

This invention provides a single motor means such as motor means 82 (FIG. 5) for use when each sheet feeder 18*a*–f is operating at the same speed as the other sheet feeders. It also includes a plurality of motors such as motors 82 and 84 and others so that a motor is dedicated to each sheet feeder 18*a–f* whereby each sheet feeder is independently controlled and run at a preselected speed. Thus, if it is desired to operate one or more of the sheet feeders at two times, three times, or more times the speed of the other sheet feeders, such differing speeds of operation can be accomplished.

In a six sheet feeder machine, there could be four regular motors, one stepper motor and one high speed motor. Any combination of motors is available; the motors depicted in FIG. 5 are merely exemplary.

All motors in machine 10 are under the control of novel control means or programmable logic controller (PLC) 86 which is electrically connected to monitor 88 and control panel 90. Pushbutton safety switch actuator 92 is electrically connected in series to push-button switch actuators 94 and 98 so that said switch actuators do not work unless switch actuator 92 is activated simultaneously. Depressing switch actuators 92 and 98 at the same time starts the novel machine. Depressing switch actuators 92 and 94 at the same time jogs the machine, i.e., the machine runs only for so long as the depression of said switches is maintained. Depressing switch actuator 96 re-sets the controls of the machine but does not result in operation of any moving parts. Accordingly, it is not in series with safety switch 92. Push-button switch actuator 100 is the stop switch and is also not in series with safety switch actuator 92. The physical spacing of safety switch actuator 92 from switch actuators 94 and 98 is a well-known safety feature that ensures that the machine operator's hands are safely away from moving parts when the machine is operated.

PLC 86 is programmable so that sheet feeders 18*a–f* are individually controllable.

Figure 6:
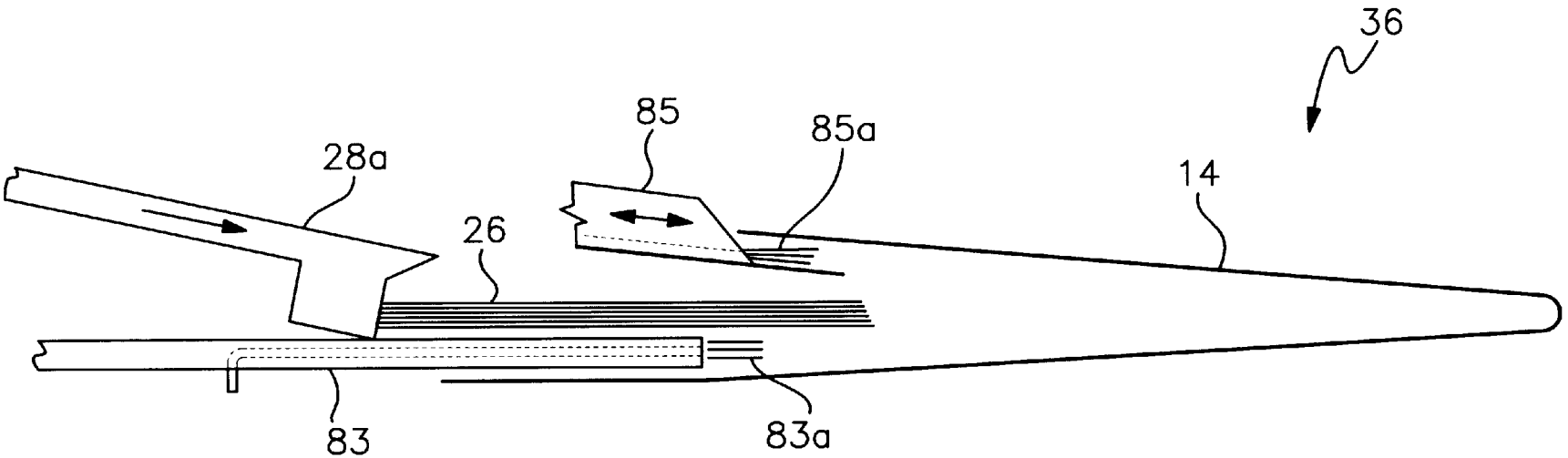
FIG. 6 is a diagrammatic side elevational view of the novel envelope-opening means.
Figure 6A:
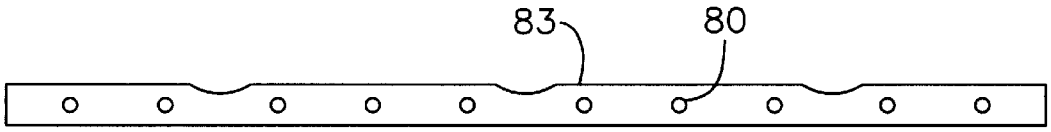
FIG. 6A is a diagrammatic front elevational view of the novel insert plate, depicting the air jets formed therein.

Referring now to FIG. 6, when an envelope 14 arrives at sheet insertion station 36, air is blown thereinto to open said envelope so that insert entering finger 85 may be inserted thereinto to hold the envelope open during the sheet insertion process. The air, denoted 83*a*, flows out of a plurality of parallel, horizontally disposed air jets 80 (FIG. 6A) that are formed in insert plate 83, said insert plate being flush with the top surface of table means 16. The jets have a longitudinal axis parallel with the longitudinal axis of table means 16 and they are transversely spaced apart from one another as indicated in FIG. 6A so that said jets supply air along the entire extent of the envelope to be opened. A sensor means 37 (FIG. 5) detects the presence of an envelope at sheet insertion station 36 and actuates a pneumatic means, not shown, that delivers the brief puff of air, from said jets, into said envelope so that it is momentarily opened. An item such as a sheet of paper or a small stack of papers 26 in inserted, by pusher member 28*a*, into the envelope during the brief time it is open.

Thus, each envelope 14 is already open by the time it arrives at sheet insertion station 36. This enhances the productivity of machine 10 because prior art machines deliver closed envelopes to a sheet insertion station as mentioned earlier. In the prior art machine, envelope-opening suction cups are brought down to grab each closed envelope as it arrives at the sheet insertion station. Significantly, the envelope must be at a complete stop before it can be engaged by the suction cups. After the sheet insertion, the suction cups must then be disengaged before the envelope can resume movement. By eliminating the suction cups and the mechanical means for lowering them into engagement with each envelope and for thereafter lifting them out of said engagement, the mechanical complexity of the machine is reduced and the cycle time for performing a sheet insertion is substantially reduced.

Element 85 in FIG. 6 is known in the industry as an insert entering finger; it holds an open envelope in its open position during the insertion process. It also serves as a guide means for guiding the sheets into the envelope and for holding said sheets down. This invention improves a conventional insert entering finger by adding air jets formed in the leading edge of said insert entering finger 85 to enhance its effectiveness. A blast of air from said jets is denoted 85*a*; note the downward direction of the air blast which serves to hold the sheets down.

If an envelope is not delivered to sheet insertion station 36, or if an incomplete set of sheets is delivered to said station, as sensed by sensor means 39 (FIG. 5), a burst of air delivered by upwardly pointing air jets, centered in openings 81, 81, ejects the set of sheets or incomplete set of sheets out of said station 36. The air is supplied by a pneumatic means, not shown, that is actuated by said sensor means 39. This ejection means allows machine 10 to continue operating when the above-mentioned events occur. Prior art machines must be stopped when such events occur. The provision of an ejection means at the point of sheet insertion was heretofore unknown.

Sensor means 41, also depicted in FIG. 5, senses the level of envelopes in envelope hopper 32 and re-starts the conveyor belt carried by the first table means to replenish said hopper with additional envelopes in the absence of operator intervention. Sensors are also provided for each sheet feeder to start and stop said feeders to stage the pieces of paper.

Unlike the pivotally-mounted, reciprocating pusher means of the prior art, novel pusher assembly 28 is provided in the form of a plurality of pusher members that follow a path of travel that forms a closed loop. As mentioned above, there are two, three or four sets of pusher members, depending upon the length of the sheets being inserted, and each set of pusher members may include one or more push arms disposed in transversely spaced apart relation to one another, as best indicated in FIG. 1. The number of push arms within each set may be varied because the number of push arms in a set is not critical.

A top view of the pusher member sets is provided in FIG. 1 and a side view thereof is provided in FIG. 2. Arcuate arrow 29 in FIG. 2 indicates that the pusher member sets retreat from sheet insertion station 36 for the first half of their path of travel and advance toward said station 36 during the second half of said path of travel. It is during the second half of said path of travel that a set of pusher members such as pusher set 28*c* (FIG. 2B) engage a sheet of paper or a short stack of papers and push said sheet or stack towards the envelope insertion station 36. Pusher members 28*d* are depicted in said FIG. 2B pushing a sheet or stack of sheets into opened envelope 14 during the release of the above-mentioned puff of air.

Note that the sets of pusher members in the retreat section of the path of travel are disengaged from said sheets but are rotating into position to sequentially perform the functions being performed by the advancing pusher members.

Parallel, longitudinally extending grooves, not shown, are formed in insert plate 83 (see FIG. 6) and the respective lowermost ends of pusher members 28*a–d* are slideably received within said grooves when the pusher members move toward envelope insertion station 36. This enables the pusher members to extend slightly below said top surface to ensure substantially problem-free insertion of the sheets into the envelopes. There is one groove for each pusher member.

Figure 7:
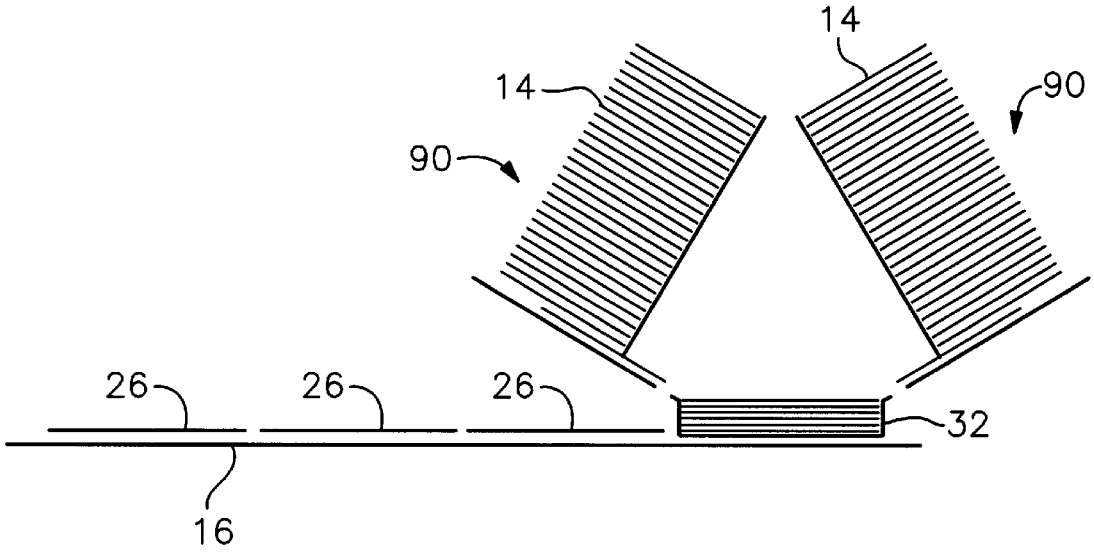
FIG. 7 is a diagrammatic front view of a high capacity demand envelope feeder.

FIG. 7 discloses an alternative means for delivering envelopes to envelope hopper 32. This means does not include elongate first table 12. Instead, a high capacity demand feeder 90 delivers envelopes to hopper 32 to ensure that said hopper does not run out of envelopes. Feeder 90 is canted from a vertical axis as depicted and may be provided with other means as well to ensure that the lowermost envelope in the stack of envelopes does not carry the weight of all envelopes above it. The novel high capacity demand feeder of FIG. 7 delivers envelopes to hopper 32 in a direction normal to the direction of arrow 42 in FIG. 1, i.e., the envelopes are displaced in a transverse direction, entering edgewise into said hopper. The high capacity demand feeders heretofore known feed envelopes in the direction of said arrow 42. Note that FIG. 7 shows two feeders 90 in flanking relation to envelope hopper 32; this is intended merely to indicate that a single feeder 90 may be placed in either side of said hopper 32.

This invention represents a major breakthrough in the art of machines that insert sheets into envelopes. Being drawn to a pioneering invention, the claims that follow are entitled, as a matter of law, to broad interpretation to protect the heart or essence of the invention from piracy.

It will thus be seen that the objects set forth above, and those made apparent from the foregoing description, are efficiently attained. Since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A machine for inserting preselected items such as sheets of paper into envelopes, comprising:

a first table means including an elongate envelope feed conveyor means;

a second table means disposed in substantially parallel relation to said first table means, said second table means including an elongate sheet feed conveyor means, at least one sheet feeder means and at least one sheet pusher means;

a third table means disposed substantially transversely to said first table means and said second table means;

said third table means including an envelope loading station aligned with said elongate envelope feed conveyor means and an envelope insertion station aligned with said elongate sheet feed conveyor means, said envelope loading station and said envelope insertion station being transversely spaced apart with respect to one another;

said envelope loading station including an envelope hopper; and said elongate envelope feed conveyor means adapted to hold an elongate queue of envelopes aligned with said envelope hopper so that keeping said envelope hopper full of envelopes requires infrequent additions of envelopes to said queue.

2. The machine of claim 1, wherein said envelope hopper has a predetermined elevation less than a predetermined elevation of said elongate envelope feed conveyor means, each envelope in said elongate queue of envelopes following a downward path of travel having a rounded ninety degree bend as it travels from said elongate envelope feed conyeyor means to said envelope hopper, said difference in elevations of said envelope hopper and said elongate envelope feed conveyor means being predetermined to maintain a constant predetermined pressure on a lowermost envelope in said envelope hopper.

3. The machine of claim 2, wherein said envelope loading station includes a sheet insertion station that is transversely spaced apart from said envelope hopper.

4. The machine of claim 3, further comprising an envelope displacement means for displacing an envelope from said envelope hopper to said sheet insertion station.

5. The machine of claim 4, wherein said envelope displacement means includes a clamp adapted to selectively engage and release an envelope, said clamp being mounted on a rotating chain means that follows a predetermined path of travel in a substantially vertical plane, said clamp adapted to engage an envelope in said envelope hopper, to displace said envelope to said sheet insertion station, and to release said envelope at a predetermined location after displacing it away from said sheet insertion station.

6. The machine of claim 5, further comprising a first cam means for opening and closing said clamp when said clamp is positioned in predetermined juxtaposition to said envelope hopper, said first cam means opening said clamp to enable it to receive an envelope at said envelope hopper and said first cam means closing said clamp at said envelope hopper to enable it to displace said envelope to said sheet insertion station.

7. The machine of claim 6, further comprising a second cam means for opening said clamp at a predetermined location after a preselected sheet has been inserted into said envelope at said sheet insertion station.

8. The machine of claim 7, wherein said clamp includes a pair of opposed jaws and further comprising a bias means for maintaining said jaws in a normally closed configuration.

9. The machine of claim 8, wherein said second cam means is transversely spaced apart from said first cam means.

10. The machine of claim 3, further comprising at least one upwardly-pointing air jet positioned at said envelope insertion station, a sensor means for detecting whether an envelope is positioned at said envelope insertion station, and pneumatic means actuated by said sensor means for causing a burst of air to flow through said at least one upwardly-pointing air jet to dislodge a sheet of paper from said envelope insertion station if said sensor means detects an absence of said envelope.

11. The machine of claim 1, wherein said at least one sheet pusher member is mounted on a predetermined structure including a rotating endless loop, said at least one sheet pusher member following a predetermined path of travel that alternately carries it toward said sheet insertion station and away from said sheet insertion station.

12. The machine of claim 11, wherein said at least one sheet pusher member includes at least one set of sheet pusher members, said at least one set including a plurality of sheet pusher members disposed in transversely spaced apart relation to one another.

13. The machine of claim 12, wherein said at least one set of sheet pusher members includes a plurality of sets of sheet pusher members that are longitudinally spaced apart from one another at equidistantly spaced intervals.

14. The machine of claim 13, further comprising a plurality of parallel, longitudinally-extending grooves formed in a top surface of said second table for respectively slideably receiving a lowermost end of said pusher members.

15. The machine of claim 1, further comprising a plurality of transversely spaced apart air outlets formed in an insert plate that is flush with a top surface of said second table means in juxtaposition to said envelope insertion station, a sensor means for detecting presence of an envelope in said envelope insertion station, and a pneumatic means actuated by said sensor means for causing a puff of air to flow from said air outlets to open an envelope positioned in said envelope insertion station.

16. The machine of claim 1, further comprising:

a high speed demand envelope feeder means for delivering envelopes to said envelope hopper, said high speed demand envelope feeder means being adapted to hold a large plurality of envelopes so that keeping said envelope hopper full of envelopes requires infrequent additions of envelopes to said high speed demand envelope feeder means.

17. The machine of claim 1, further comprising an insert entering finger means for holding open an envelope positioned at said sheet insertion station, and further comprising at least one air jet formed in a leading end of said insert entering finger means, said air jet being in fluid communication with a source of air under pressure and further including means for releasing a burst of air from said insert entering finger means when said insert entering finger means is positioned in its operative position where it holds open an envelope.

18. The machine of claim 17, wherein said envelope loading station includes a sheet insertion station that is transversely spaced apart from said envelope hopper.

19. The machine of claim 17, wherein said at least one sheet pusher member is mounted on a predetermined structure including a rotating endless loop, said at least one sheet pusher member following a predetermined path of travel that alternately carries it toward said sheet insertion station and away from said sheet insertion station.

* * * * *